US010627139B2

(12) United States Patent
Hartfield et al.

(10) Patent No.: US 10,627,139 B2
(45) Date of Patent: Apr. 21, 2020

(54) SUCTION DUCT AND MULTIPLE SUCTION DUCTS INSIDE A SHELL OF A FLOODED EVAPORATOR

(71) Applicant: TRANE INTERNATIONAL INC., Davidson, NC (US)

(72) Inventors: Jon P. Hartfield, La Crosse, WI (US); H. Kenneth Ring, Jr., Houston, MN (US); Steven E. Meloling, La Crosse, WI (US); Florian Weber, Richardmenil (FR); Alain Fleurette, Chamagne (FR); Benjamin Elias Dingel, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 197 days.

(21) Appl. No.: 15/525,708

(22) PCT Filed: Nov. 11, 2015

(86) PCT No.: PCT/US2015/060115
§ 371 (c)(1),
(2) Date: May 10, 2017

(87) PCT Pub. No.: WO2016/077436
PCT Pub. Date: May 19, 2016

(65) Prior Publication Data

US 2018/0299172 A1 Oct. 18, 2018

Related U.S. Application Data

(60) Provisional application No. 62/078,155, filed on Nov. 11, 2014.

(30) Foreign Application Priority Data

Jun. 29, 2015 (FR) ..... 15 56092

(51) Int. Cl.
*F25B 39/02* (2006.01)
*F28D 21/00* (2006.01)
*F25B 5/02* (2006.01)

(52) U.S. Cl.
CPC ..... *F25B 39/028* (2013.01); *F25B 5/02* (2013.01); *F28D 21/0017* (2013.01); *F25B 2339/0242* (2013.01)

(58) Field of Classification Search
CPC ..... F25B 2339/0242; F28D 7/0066; F28D 7/0075; F28D 21/0017
See application file for complete search history.

(56) References Cited

U.S. PATENT DOCUMENTS 1,937,802 A 12/1933 Bear
2,151,863 A 3/1939 Millard
(Continued)

FOREIGN PATENT DOCUMENTS

CN 102435022 A 5/2012
CN 104654675 A 5/2015
(Continued)

OTHER PUBLICATIONS

International Search Report and Written Opinion, International Patent Application No. PCT/US2015/060115, dated Feb. 3, 2016 (10 pages).
(Continued)

*Primary Examiner* — Kun Kai Ma
(74) *Attorney, Agent, or Firm* — Hamre, Schumann, Mueller & Larson, P.C.

(57) ABSTRACT

A suction duct is disposed within a shell and tube heat exchanger. The suction duct is located relatively high and above the tube bundle so as to not entrain liquid or droplets that may be splashing and spraying upward. The suction duct is configured with an area schedule in fluid communi-
(Continued)

cation with a flow path inside the suction duct. The flow path is in fluid communication with an outlet of the shell. This is advantageous relative to traditional top of the shell outlets which generally have higher vertical footprints. The area schedule of the suction duct can facilitate and/or maintain relatively smooth vapor flow within the shell. The area schedule can achieve vapor flows that have some uniformity along the length of the shell, which can manage and/or avoid localized vapor flow and/or local currents, such as where high velocity may be present and where entrainment can result.

1 Claim, 12 Drawing Sheets

(56) References Cited

U.S. PATENT DOCUMENTS

| | | | | |
|---|---|---|---|---|
| 2,819,592 | A | 1/1958 | Smith | |
| 6,910,349 | B2 | 6/2005 | Bodell et al. | |
| 9,033,029 | B2 * | 5/2015 | Park | F28F 9/0273 165/151 |
| 2008/0302130 | A1 * | 12/2008 | Wang | F25B 39/02 62/512 |
| 2010/0132927 | A1 * | 6/2010 | Benetton | F25B 39/02 165/158 |
| 2010/0139898 | A1 * | 6/2010 | Hung | F25B 39/02 165/110 |
| 2011/0017432 | A1 | 1/2011 | Kulankara et al. | |
| 2011/0226005 | A1 | 9/2011 | Lee | |

FOREIGN PATENT DOCUMENTS

| | | |
|---|---|---|
| JP | 2002-081699 A | 3/2002 |
| WO | 2008-112549 | 9/2008 |
| WO | 2013-049219 | 4/2013 |
| WO | 2013/182314 | 12/2013 |
| WO | 2014-056151 | 4/2014 |

OTHER PUBLICATIONS

French Preliminary Search Report and Written Opinion, French Patent Application No. FR1556092, dated May 20, 2016 with English translation (9 pages).

Office Action; Chinese Patent Application No. 201580072666.0, dated Mar. 27, 2019, with partial English translation (11 pages).

* cited by examiner

SUCTION DUCT AND MULTIPLE SUCTION DUCTS INSIDE A SHELL OF A FLOODED EVAPORATOR

FIELD

Embodiments disclosed herein generally relate to a suction duct in a heat exchanger. In particular, apparatuses, systems and methods are directed to a refrigerant vapor suction duct implemented in a flooded evaporator, such as a shell and tube evaporator, as part of a fluid circuit in a chiller unit, which may be implemented in refrigeration system of a heating, ventilation, and air conditioning (HVAC) system.

BACKGROUND

Suction ducts are employed in heat exchangers for example to take up evaporated fluids, such as fluids containing refrigerant vapor, to be transferred to other parts of a circuit, such as a cooling circuit for example a fluid chiller in a HVAC system.

SUMMARY

Heat exchangers can employ suction ducts that can for example direct fluid vapor out of the heat exchanger and to other parts of a fluid heat exchange circuit.

One example of such a heat exchanger is a shell and tube heat exchanger. In some embodiments, the shell and tube heat exchanger is a flooded-type evaporator that has a charge of refrigerant inside the shell to wet the tubes, e.g. tube bundle, and where a heat exchange fluid, such as for example a refrigerant or mixture including refrigerant is boiled or evaporated off the tubes and flows upwards within the shell.

For example, the tubes or tube bundle is disposed toward the bottom section of the shell, where vapor that is boiled off is drawn toward the top of the shell or to a relatively high position inside the shell.

A suction duct is disposed within the shell, and is located relatively high and above the tube bundle so as to not entrain liquid or droplets that may be splashing and spraying upward. The suction duct is configured with an area schedule, such as for example openings, which may be in some circumstances in the form of slots, holes, apertures, various geometrically shaped openings, and the like. The suction duct has the advantage of carrying vaporized fluid, e.g. refrigerant vapor or gas, to an outlet of the shell by way of the suction duct.

In some embodiments, the outlet of the shell is out of the side, such as for example at a longitudinal end thereof. A flow path inside the suction duct is in fluid communication with the area schedule and with the outlet of the shell. This is advantageous relative to traditional top of the shell outlets which generally have higher vertical footprints.

In some embodiments, the flow path of the suction duct is through a tube sheet which is then in fluid communication with the outlet of the shell.

In some embodiments, the suction duct extends along the longitudinal length of the shell.

Advantageously, the suction duct configurations herein can avoid the occurrence of localized phenomena, e.g. localized vapor flow, and can maintain relatively smooth vapor flow. In some embodiments, the suction duct has an area schedule configuration, where the openings into the flow path of the suction duct can achieve vapor flows that are uniform or have some uniformity along the length of the shell and the suction duct. Such configurations can manage or avoid localized vapor flow and/or local currents, such as where high velocity may be present and where entrainment can result.

In some embodiments, the suction duct has an area schedule that can be configured, constructed, located, and/or arranged so as to manipulate, control, and/or meter vapor flows and/or currents.

In some embodiments, the area schedule in the suction duct can generally facilitate vapor flow that is upward and curved, for example toward a location of the shell with a relatively lower pressure, and then be taken into the flow path of the suction duct toward the outlet on the side of the shell.

In some embodiments, this upward and to the side flow can have a relatively smooth curvature flow.

In an embodiment, one or more suction ducts as described in any one or more of paragraphs [0006] to [0013] may be disposed within the shell of a heat exchanger, such as but not limited to an evaporator, which in some instances is a flooded-type evaporator.

In some embodiments, the heat exchangers herein can be implemented in a fluid chiller unit, such as may be included in an HVAC or refrigeration system.

In some embodiments, the heat exchangers herein can be used in a fluid chiller, such as for example a screw compressor fluid chiller, which may be employed for example in a HVAC and/or refrigeration unit and/or system.

In some embodiments, the heat exchangers herein may be used in relatively large centrifugal compressor fluid chillers.

Generally, in some embodiments, the heat exchangers herein can be used in fluid chillers that may have pressure drop issues. In some examples, such fluid chillers may employ a relatively higher pressure refrigerant, such as but not limited to for example R134A.

DRAWINGS

These and other features, aspects, and advantages of the heat exchanger and suction duct will become better understood when the following detailed description is read with reference to the accompanying drawing, wherein.

While the above-identified figures set forth particular embodiments of the heat exchanger and suction duct, other embodiments are also contemplated, as noted in the descriptions herein. In all cases, this disclosure presents illustrated embodiments of the heat exchanger and suction duct are by way of representation but not limitation. Numerous other modifications and embodiments can be devised by those skilled in the art which fall within the scope and spirit of the principles of the heat exchanger and suction duct described and illustrated herein.

DETAILED DESCRIPTION

Embodiments disclosed herein relate generally to a heat exchanger with a suction duct inside the heat exchanger, and configured to direct fluid vapor, such as for example including refrigerant vapor, laterally through a flow path of the suction duct and through a lateral or side exit on the side of the heat exchanger.

In particular, apparatuses, systems and methods are directed to suction ducts within a heat exchanger, such as for example a shell tube heat exchanger which may operate as a flooded evaporator, and implemented in a chiller unit of an HVAC or refrigeration system.

Figure 1:
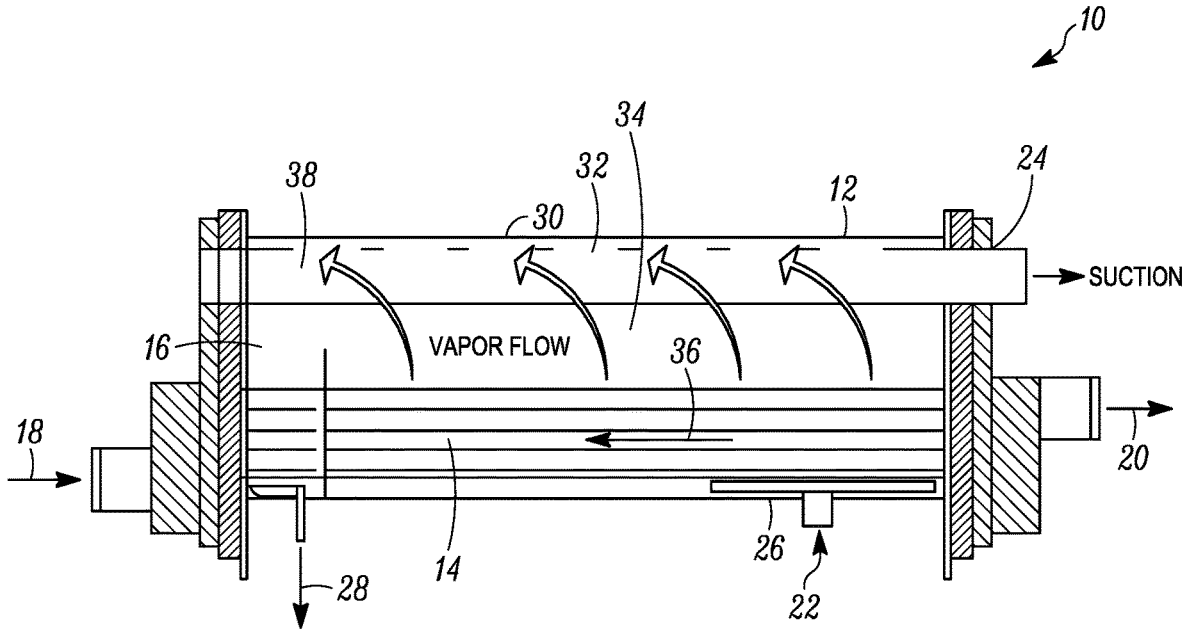
FIG. 1 is a side view of one embodiment of a heat exchanger showing one embodiment of a suction duct within the heat exchanger.
Figure 2:
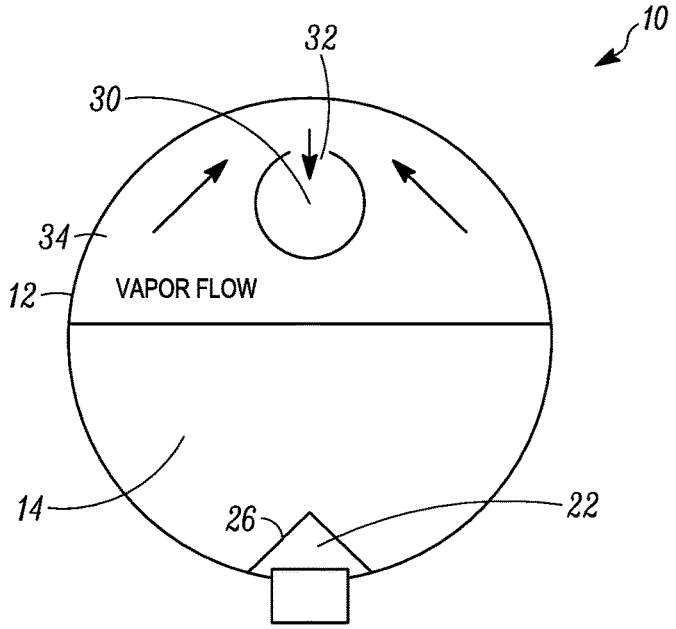
FIG. 2 is an end schematic view of the heat exchanger and suction duct of FIG. 1.

FIGS. 1 and 2 are directed to an embodiment of a heat exchanger 10. FIG. 1 is a side view of one embodiment of the heat exchanger 10 showing one embodiment of a suction duct 30 within the heat exchanger 10. FIG. 2 is a sectional view of the heat exchanger 10 and suction duct 30 of FIG. 1.

The heat exchanger 10 as shown is a shell and tube heat exchanger. In some embodiments, the shell and tube heat exchanger 10 is implemented as a flooded-type evaporator that has a charge of refrigerant inside the shell 12 to wet the tubes 14, e.g. tube bundle, and where a heat exchange fluid, such as for example a refrigerant or mixture including refrigerant is boiled or evaporated off the tubes 14 and flows upwards within the shell 12.

The heat exchanger 10 has an inlet 18 on one side (e.g. water inlet) and an outlet 20 on the other side (e.g. water outlet). As shown the inlet 18 and outlet 20 represent longitudinal ends from the shell 12, where the tubes 14 extend lengthwise along the longitudinal direction of the shell 12.

The heat exchanger 10 also includes a heat exchange fluid inlet 22, which can be in fluid communication with a distributor 26. In some examples, the heat exchange fluid is refrigerant, which may include a mixture of refrigerant (including vapor and liquid) and lubricant such as for example oil. As shown, the heat exchange fluid inlet 22 is located or disposed proximate to the outlet 20 side. As shown, the heat exchanger 10 also includes an oil recovery port 28 for directing oil that may pool in the shell 12. In some examples such as shown in FIG. 1, the oil recovery port 28 is located or disposed proximate the inlet 18 side.

As shown, the tubes 14 are disposed toward the bottom section of the shell 12. When the heat exchanger 10 is operating as an evaporator, the tubes 14 (e.g. tube side) can carry a process fluid such as for example water, which may be relatively warmer than the refrigerant entering the shell 12. Refrigerant vapor that is boiled off (see arrows and item 34) is drawn through a portion of the volume 16 of the shell 12, and toward the top of the shell 12 or to a relatively high position inside the shell 12.

The heat exchanger 10 also includes inside the shell 12 a suction duct 30. The suction duct 30 is disposed within the shell 12, and is located relatively high and above the tubes 14, so as to not entrain liquid or droplets that may be splashing and spraying upward. The suction duct 30 is configured with an area schedule 32, such as for example openings, which may be in some circumstances in the form of slots, holes, apertures, various geometrically shaped openings, and the like. The suction duct 30 can have the advantage of carrying vaporized fluid, e.g. refrigerant vapor or gas, to a vapor outlet 24 of the shell 12 by way of the suction duct 30.

In some embodiments, the vapor outlet 24 of the shell 12 is out of the side, such as for example at a longitudinal end thereof, e.g. outlet end 20. A flow path 38 inside the suction duct 30 is in fluid communication with the area schedule 32 and with the vapor outlet 24 of the shell 12. The lateral flow path 38 and vapor outlet 24 can be advantageous for example relative to traditional top of the shell outlets, which generally have higher vertical footprints.

In some embodiments, the flow path 38 of the suction duct 30 is through a tube sheet (see e.g. plate at end 20 of the shell 12), and is in fluid communication with the vapor outlet 24 of the shell 12.

In some embodiments, the suction duct 30 extends along the longitudinal length of the shell 12.

In some embodiments, the suction duct 30 can be cylindrical or tube-like, but can be other shapes and geometries. For example, the suction duct may be constructed as a sheet material, such as metal, curved, bent or otherwise formed to have a bottom barrier facing downward and open area(s) about or at the top. For example, the bottom can be a V-like shape, half-moon or crescent-like shape, other cup-like shape, or other aerodynamic type shape for the bottom barrier, and the like.

In some examples, the suction duct can have its flow path configured to be insertable through a tube sheet, such as for example a circular type opening at the end of the tube sheet, where the bottom barrier can have for example any of the shapes described above to be insertable through the tube sheet. In some circumstances, the geometry of the suction duct e.g. the bottom barrier, is fitted or adapted with the opening of the tube sheet, e.g. through the circular opening of the tube sheet. In an embodiment, the tube sheet opening may not be circular and can be modified to accommodate the geometry of the suction duct so it may be inserted into the tube sheet.

For example, the suction duct includes a circular opening designed to be insertable through a tube sheet, and where barriers such as may be constructed by sheet metal, may be oriented, arranged, and/or configured to connect or fit to the opening in the tube sheet. Openings such as slots may be along side(s) of the sheet metal, where the slots are relatively high on a height of the sheet metal.

Advantageously, the suction duct 30 configurations herein can avoid the occurrence of localized phenomena, e.g. localized vapor flow, and can maintain relatively smooth vapor flow. In some embodiments, the area schedule 32 configuration of the suction duct 30 can be configured, where the openings of the area schedule 32 into the flow path 38 of the suction duct 30 can achieve vapor flows that are uniform or have some uniformity along the length of the shell 12 and/or the suction duct 30. Such configurations can manage or avoid localized vapor flow and/or local currents, such as where relatively higher velocities may be present and where there may be a risk of liquid entrainment.

In some embodiments, the area schedule 32 can be configured, constructed, located, and/or arranged so as to manipulate, control, and/or meter vapor flows and/or currents.

In some embodiments, the area schedule 32 in the suction duct 30 can generally facilitate vapor flow that is upward and to the side toward the outlet on the side of the shell. See e.g. vapor flow curved arrows at 34 within the volume 16 of the shell 12.

In some embodiments, this upward and to the side flow can have a relatively smooth curvature flow.

The design of the area schedule 32 can be achieved for example by looking at the flow of liquid, which is sometimes a mixture of lubricant (e.g. oil) and refrigerant (see e.g. arrow at 36), and the direction of the liquid flow where lubricant is increasing as refrigerant is boiled off or vaporized (see e.g. arrows at 34). In some cases, there can be areas within the shell 12 that may be susceptible to relatively higher occurrences of foaming, e.g. of lubricant, and where it may be desired to keep vapor currents relatively more benign. In some circumstances, it may be desired to have co-current flow of the flow of liquid (e.g. arrow at 36) and the flow of vapor (e.g. arrows at 34), so as not create occurrences of splash back or cause for example the direction of vapor flow to fight back against direction of liquid flow. In some embodiments, the area schedule, e.g. 32, can be configured to direct the flow of vapor so that is relatively biased with the direction of the liquid flow. Axial distribution of the vapor within the shell 12 can be generated using heat transfer models and then controlling the area schedule 32, e.g. openings, to handle the vapor generation and achieve velocity vectors that may be desired. For example, heat transfer models, vapor generation models, and/or flash gas models (e.g. to account for vapor already generated by an expansion device when two-phase vapor and liquid flows into the shell from a distributor and to account for flows impacted by a distributor) can be used and/or computational fluid dynamics (CFD) testing can be performed, and the like.

The area schedule 32 can have a variable resistance for example along the length of the suction duct 30, and can be designed to control vapor velocity vectors, e.g. straight up, curved, and the like. The area schedule 32 can be designed to influence the flow field, which can be modeled as described above.

In some cases, there may be relatively more vapor generation where refrigerant enters the shell 12 at the fluid inlet 22 (e.g. toward the water outlet side 20), where there may be relatively higher velocities. In such circumstances it may be desired to have relatively smaller openings for the area schedule 32 toward the water outlet side 20 relative to the openings toward the other end, e.g. water inlet side 18.

Such vapor biasing can be in the same direction as the pooling of lubricant (e.g. oil). As shown in FIG. 1, oil concentration is on the left toward oil recovery port 28, where liquid flow from the right, and where the velocities can bias to facilitate pool flow, and vapor currents can flow relatively smoothly upward and to the side (e.g. curved).

The suction ducts herein, e.g. 30, may provide some pressure drop but where carryover can be reduced, while using a vapor biasing scheme and side outlet.

It will be appreciated that the area schedule 32 can be configured any number of ways. In some embodiments, area schedule 32 can be openings such as for example slots or openings with various geometries, including for example circular, oblong, square, rectangular, and the like.

In some embodiments, the area schedule 32 can include openings configured as louvers, such as but not limited to bent material from sheet metal to create the openings, while also including an additional barrier.

It will be appreciated that in a single pass of tubes (e.g. as shown in FIG. 1 from inlet 18 to outlet 20), there perhaps may be vapor generation that has a relatively less even distribution along the length of the shell 12. In some cases, multiple passes of tubes 14 (e.g. back and forth, such as from one end to the other end and back) there may be vapor generation that is relatively more evenly distributed along the length of the shell.

Figure 3:
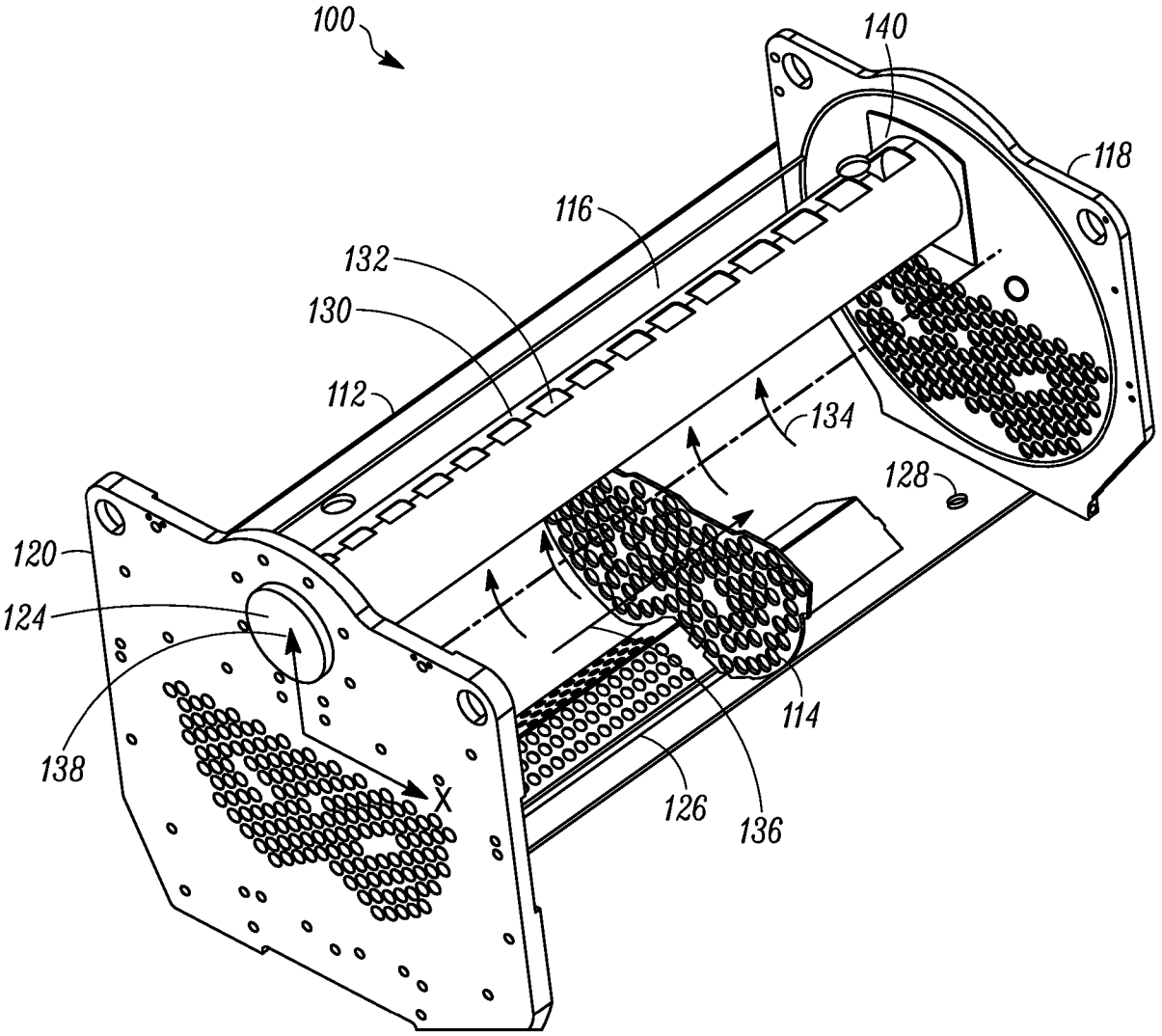
FIG. 3 is a perspective view of another embodiment of a heat exchanger showing another embodiment of a suction duct within the heat exchanger.
Figure 4:
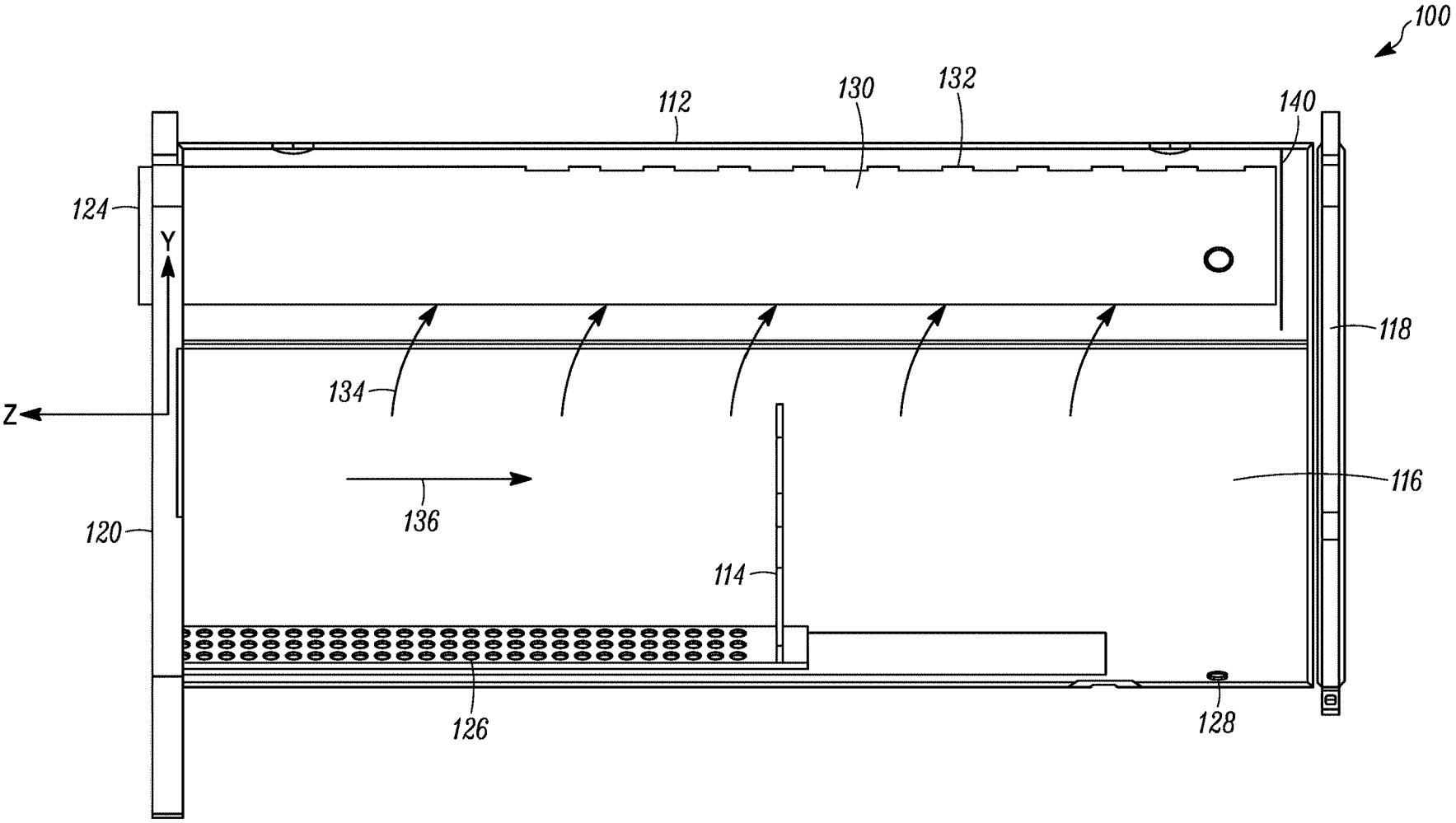
FIG. 4 is a side view of the heat exchanger and suction duct of FIG. 3.
Figure 5:
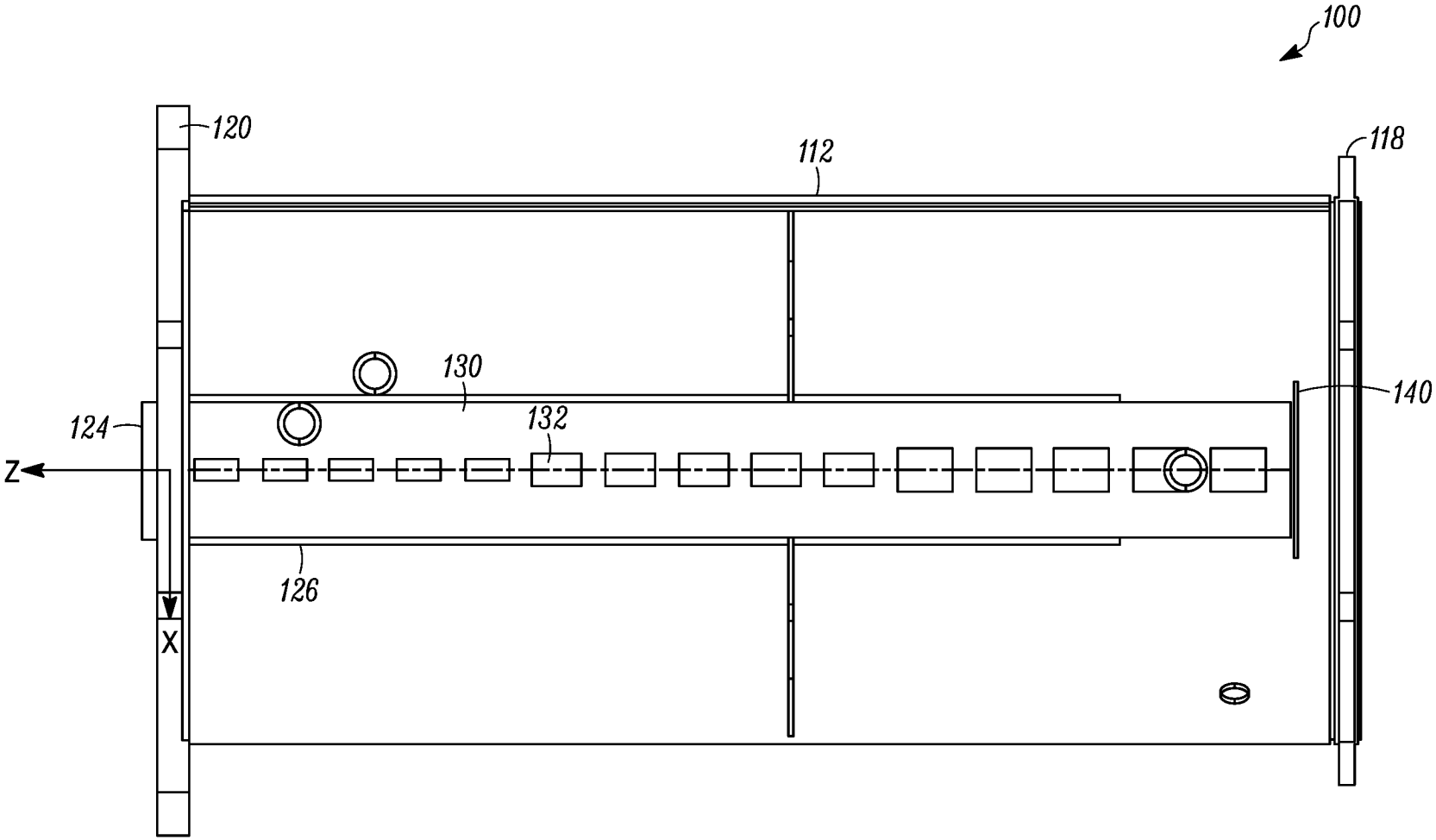
FIG. 5 is a top view of the heat exchanger and suction duct of FIG. 3.

FIGS. 3 to 5 are directed to an embodiment of a heat exchanger 100. FIG. 3 is a perspective view of the heat exchanger 100 showing another embodiment of a suction duct 130 within the heat exchanger 100. FIG. 4 is a side view of the heat exchanger 100 and suction duct 130. FIG. 5 is a top view of the heat exchanger 100 and suction duct 130.

The heat exchanger 100 as shown is a shell and tube heat exchanger. In some embodiments, the shell and tube heat exchanger 100 is implemented as a flooded-type evaporator that has a charge of refrigerant inside the shell 112 to wet the tubes, e.g. tube bundle, and where a heat exchange fluid, such as for example a refrigerant or mixture including refrigerant is boiled or evaporated off the tubes and flows upwards within the shell 112. For ease of illustration, a tube sheet 114 is shown where tubes may be inserted within the volume 116 of the shell 112.

The heat exchanger 100 has an inlet side 118 (e.g. water inlet side) on one side and an outlet side 120 (e.g. water outlet side) on the other side. As shown the inlet side 118 and outlet 120 represent longitudinal ends from the shell 112, where the tubes extend lengthwise along the longitudinal direction of the shell 12.

The heat exchanger 100 also includes a heat exchange fluid inlet (not shown) for example similar to heat exchanger 100, and which can be in fluid communication with a distributor 126. In some examples, the heat exchange fluid is refrigerant, which may include a mixture of refrigerant (including vapor and liquid) and lubricant such as for example oil. In an embodiment, the heat exchange fluid inlet (not shown in FIG. 3) is located or disposed proximate to the outlet side 120. As shown, the heat exchanger 100 also includes an oil recovery port 128 for directing oil that may pool in the shell 112. In some examples such as shown in FIG. 3, the oil recovery port 128 is located or disposed proximate the inlet side 118.

As shown, the tubes would be disposed toward the bottom section of the shell 112. When the heat exchanger 100 is operating as an evaporator, the tubes (e.g. tube side) can carry a process fluid such as for example water, which may be relatively warmer than the refrigerant entering the shell 112. Refrigerant vapor that is boiled off (see arrows and item 134) is drawn through a portion of the volume 116 of the shell 112, and toward the top of the shell 112 or to a relatively high position inside the shell 112.

The heat exchanger 100 also includes inside the shell 112 a suction duct 130. The suction duct 130 is disposed within the shell 112, and is located relatively high and above the tubes, so as to not entrain liquid or droplets that may be splashing and spraying upward. The suction duct 130 is configured with an area schedule 132, such as for example openings, which may be in some circumstances in the form of slots, holes, apertures, various geometrically shaped openings, and the like. The suction duct 130 can have the advantage of carrying vaporized fluid, e.g. refrigerant vapor or gas, to a vapor outlet 124 of the shell 112 by way of the suction duct 130.

In some embodiments, the vapor outlet 124 of the shell 112 is out of the side, such as for example at a longitudinal end thereof, e.g. outlet end 120. A flow path 138 inside the suction duct 130 is in fluid communication with the area schedule 132 and with the vapor outlet 124 of the shell 112. The lateral flow path 138 and vapor outlet 124 can be advantageous for example relative to traditional top of the shell outlets, which generally have higher vertical footprints.

In some embodiments, the flow path 138 of the suction duct 130 is through an end tube sheet (see e.g. plate at end 120 of the shell 112), which is in fluid communication with the vapor outlet 124 of the shell 112.

In some embodiments, the suction duct 130 extends along the longitudinal length of the shell 112. It will be appreciated that the suction duct 130 can extend along the entire length of the shell 112 from end to end (118 to 120), but may also extend less than the entire length of the shell 112, e.g. from the outlet end 120 where the suction duct 120 is supported.

In some examples, the suction duct can have its flow path configured to be insertable through a tube sheet, such as for example a circular type opening at the end, where the bottom barrier can have for example any of the shapes described above to be insertable through the tube sheet and can fit with the opening through the circular opening of the tube sheet and in some circumstances be fitted to the opening of the tube sheet.

For example, the suction duct includes a circular opening designed to be insertable through a tube sheet, and where barriers such as may be constructed by sheet metal, may be oriented, arranged, and/or configured to connect or fit to the opening in the tube sheet. Openings such as slots may be along side(s) of the sheet metal, where the slots are relatively high on a height of the sheet metal.

In some embodiments, the suction duct 130 can be cylindrical or tube-like, but can be other shapes and geometries. For example, the suction duct may be constructed as a sheet material, such as metal, curved, bent or otherwise formed to have a bottom barrier facing downward and open area(s) at about the top or at the top. For example, the bottom can be a V-like shape, half-moon or crescent-like shape, other cup-like shape, or other aerodynamic type shape for the bottom barrier, and the like. In some examples, the suction duct can have its flow path configured to be insertable through a tube sheet, such as for example a circular type end, where the bottom barrier can have for example any of the shapes described above, and to be in fluid communication with the circular end so that it is insertable through the tube sheet, and may fit with the tube sheet. In some circumstances, the geometry of the suction duct e.g. the bottom barrier, is fitted or adapted with the opening of the tube sheet, e.g. through the circular opening of the tube sheet. In an embodiment, the tube sheet opening may not be circular and can be modified to accommodate the geometry of the suction duct so it may be inserted into the tube sheet.

For example, the suction duct includes a circular opening designed to be insertable through a tube sheet, and where barriers, such as constructed by sheet metal may be oriented, arranged, and/or configured to makeup the suction duct that connects or fits to the opening in the tube sheet with slots along side(s) of the sheet metal, slots relatively high on height of the sheet metal.

Advantageously, the suction duct 130 configurations herein can avoid the occurrence of localized phenomena, e.g. localized vapor flow, and can maintain relatively smooth vapor flow. In some embodiments, the area schedule 132 configuration of the suction duct 130 can be configured, where the openings of the area schedule 132 into the flow path 138 of the suction duct 130 can achieve vapor flows that are uniform or have some uniformity along the length of the shell 112 and/or the suction duct 130. Such configurations can manage or avoid localized vapor flow and/or local currents, such as where high velocity may be present and where entrainment can result.

In some embodiments, the area schedule 132 that can be configured, constructed, located, and/or arranged so as to manipulate, control, and/or meter vapor flows and/or currents.

In some embodiments, the area schedule 132 in the suction duct 130 can generally facilitate vapor flow that is and curved, for example toward a location of the shell with a relatively lower pressure, and then be taken into the flow path of the suction duct toward the outlet on the side of the shell. See e.g. vapor flow curved arrows at 134 within the volume 116 of the shell 112.

In some embodiments, this upward and to the side flow can have a relatively smooth curvature flow.

The design of the area schedule 132 can be achieved for example by looking at the flow of liquid, which is sometimes a mixture of lubricant (e.g. oil) and refrigerant (see e.g. arrow at 136), and the direction of the liquid flow where lubricant is increasing as refrigerant is boiled off or vaporized (see e.g. arrows at 134). In some cases, there can be areas within the shell 112 that may be susceptible to relatively higher occurrences of foaming, e.g. of lubricant, and where it may be desired to keep vapor currents relatively more benign. In some circumstances, it may be desired to have co-current flow of the flow of liquid (e.g. arrow at 136) and the flow of vapor (e.g. arrows at 134), so as not create occurrences of splash back or cause for example the direction of vapor flow to fight back against direction of liquid flow. In some embodiments, the area schedule, e.g. 132, can be configured to direct the flow of vapor so that is relatively biased with the direction of the liquid flow. Axial distribution of the vapor within the shell 112 can be generated using heat transfer models and then controlling the area schedule 132, e.g. openings, to handle the vapor generation and achieve velocity vectors that may be desired. For example, heat transfer models, vapor generation models, and/or flash gas models (e.g. to account for vapor already generated by an expansion device when two-phase vapor and liquid flows into the shell from a distributor and to account for flows impacted by a distributor) can be used and/or computational fluid dynamics (CFD) testing can be performed, and the like.

The area schedule 132 can have a variable resistance for example along the length of the suction duct 130, and can be designed to control vapor velocity vectors, e.g. straight up, curved, and the like. The area schedule 132 can be designed to influence the flow field, which can be modeled as described above.

In some cases, there may be relatively more vapor generation where refrigerant enters the shell (e.g. toward the water outlet end 120), and where there may be relatively higher velocities. In such circumstances it may be desired to have relatively smaller openings for the area schedule 132 toward the outlet side 120 relative to the openings toward the other end, e.g. inlet side 118.

As shown in FIGS. 3 to 5 for example, the area schedule 132 can be such that at the outlet side 120 the openings can be smaller and then have increasing size toward the other end, e.g. the inlet side 118. See also FIGS. 6 to 8 described below.

Such vapor biasing can be in the same direction as the pooling of lubricant (e.g. oil). As shown in FIGS. 3 and 4, oil concentration can be on the right toward oil recovery port 128, where liquid flows from the left, and where the velocities can bias to facilitate pool flow, and vapor currents can flow relatively smoothly upward and to the side (e.g. curved).

The suction ducts herein, e.g. 130, may provide some pressure drop but where carryover can be reduced, while using a vapor biasing scheme and side outlet.

It will be appreciated that the area schedule 132 can be configured any number of ways. In some embodiments, area schedule 132 can be openings such as for example slots or openings with various geometries, including for example circular, oblong, square, rectangular, and the like.

In some embodiments, the area schedule 132 can include openings configured as louvers, such as but not limited to bent material from sheet metal to create the openings, while also including an additional barrier.

It will be appreciated that in a single pass of tubes (e.g. as shown in FIG. 3 from inlet 118 to outlet 120), there perhaps may be vapor generation that has a relatively less even distribution along the length of the shell 112. In some cases, multiple passes of tubes (e.g. back and forth, such as from one end to the other end and back) there may be vapor generation that is relatively more evenly distributed along the length of the shell.

Figure 6:
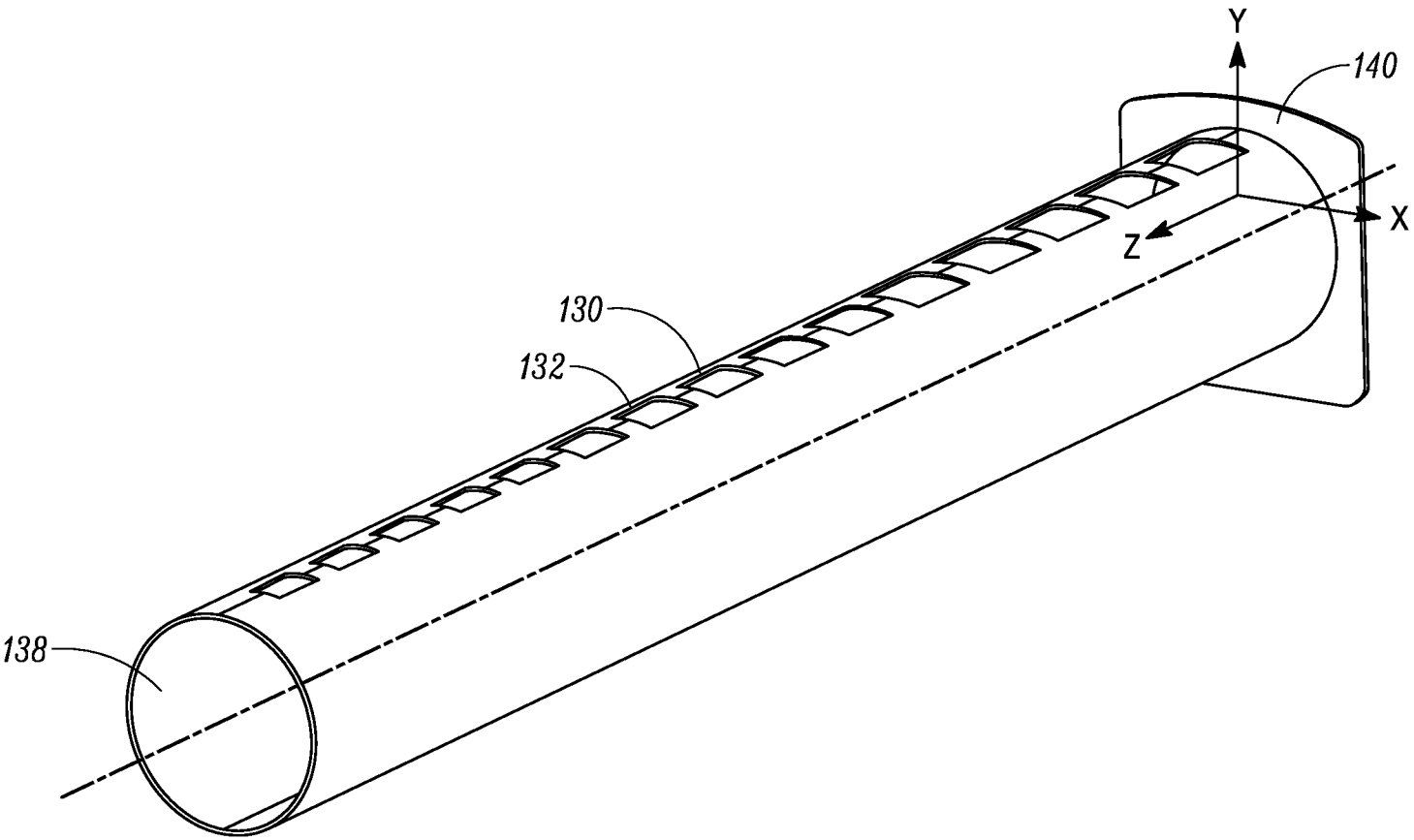
FIG. 6 is a perspective view of the suction duct of FIG. 3.
Figure 7:
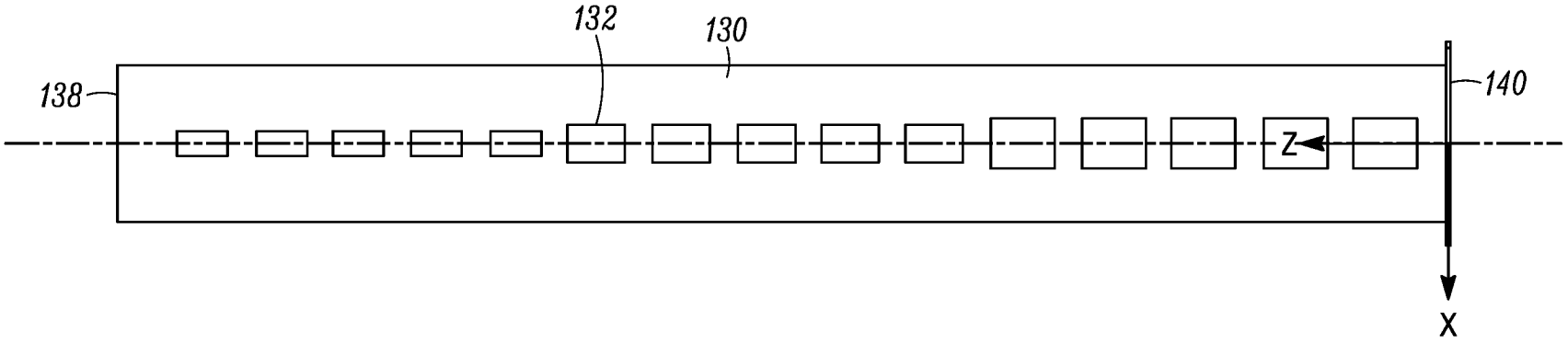
FIG. 7 is a top view of the suction duct of FIG. 3.
Figure 8:
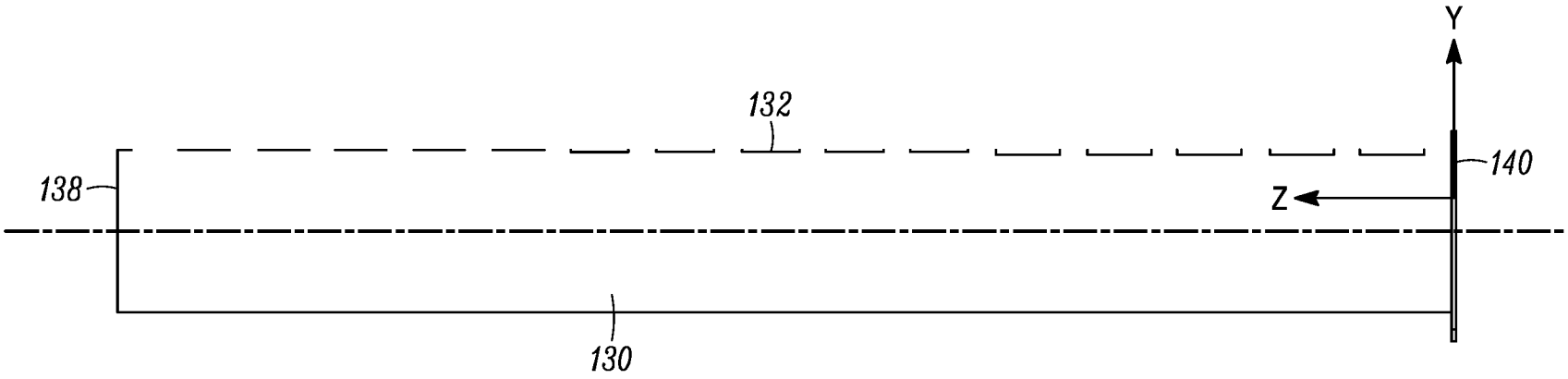
FIG. 8 is a side view of the suction duct of FIG. 3.
Figure 9:
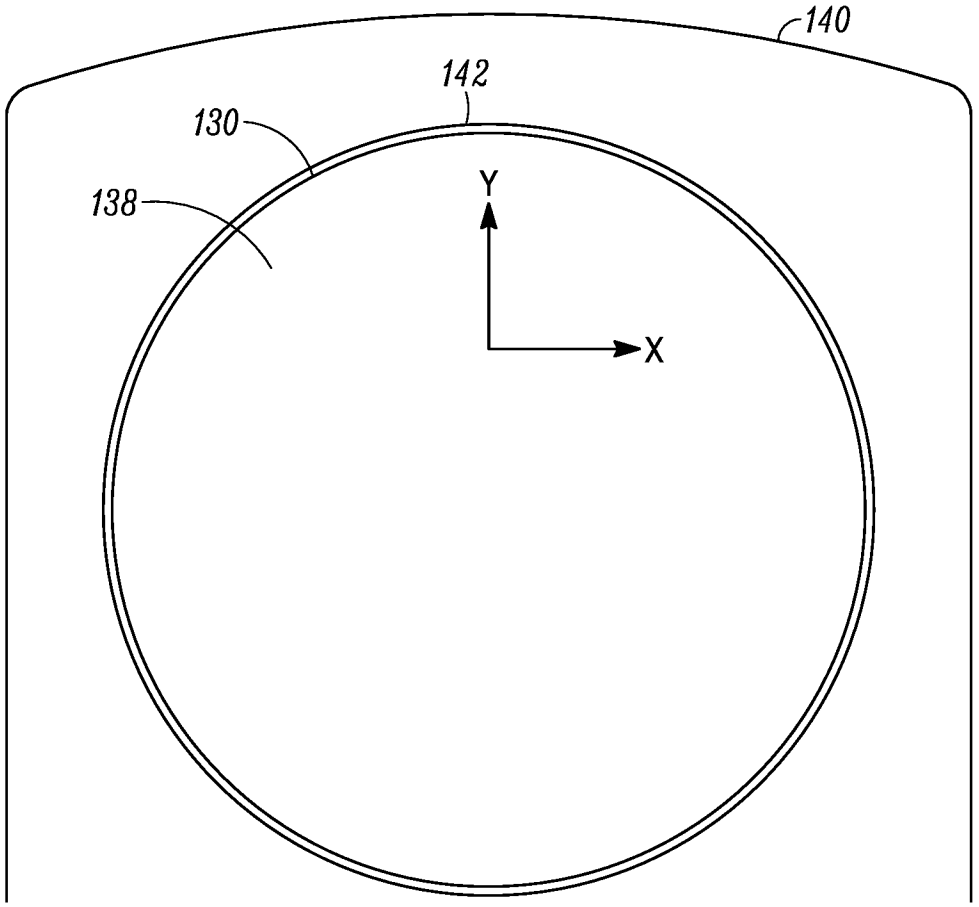
FIG. 9 is an end view of the suction duct of FIG. 3.

FIGS. 6 to 9 specifically show the suction duct 130. FIG. 6 is a perspective view of the suction duct 130. FIG. 7 is a top view of the suction duct 130. FIG. 8 is a side view of the suction duct 130. FIG. 9 is an end view of the suction duct 130. In some instances, like references numbers are not further described.

In some embodiments, the suction duct 130 has an end configured to be inserted through an opening of a tube sheet 140 or support. In some embodiments, the tube sheet 140 can have a bevel 142 to facilitate insertion of the suction duct 130 into the opening of the tube sheet 140. It will be appreciated that the suction duct 130 at its end may have the bevel 142 to facilitate insertion.

In the embodiment shown, the area schedule 132 is shown to increase from one end to the other end. For example, the openings of the area schedule 132 into the flow path 138 become larger from one end to the other end. It will be appreciated that the area schedule shown for heat exchanger 100 (as well as for heat exchanger 10) is merely exemplary and may be desired for certain type(s) of vapor flow regimes, whereas other area schedule configurations, e.g. sizes, size variations, geometries, frequencies, and the like can be employed as desired, appropriate, and/or necessary.

Dual or Multiple Suction Ducts within the Shell

In an embodiment, heat exchangers similar to the heat exchangers described above, e.g. 10, 100 may include more than one suction duct in the shell.

Figure 10:
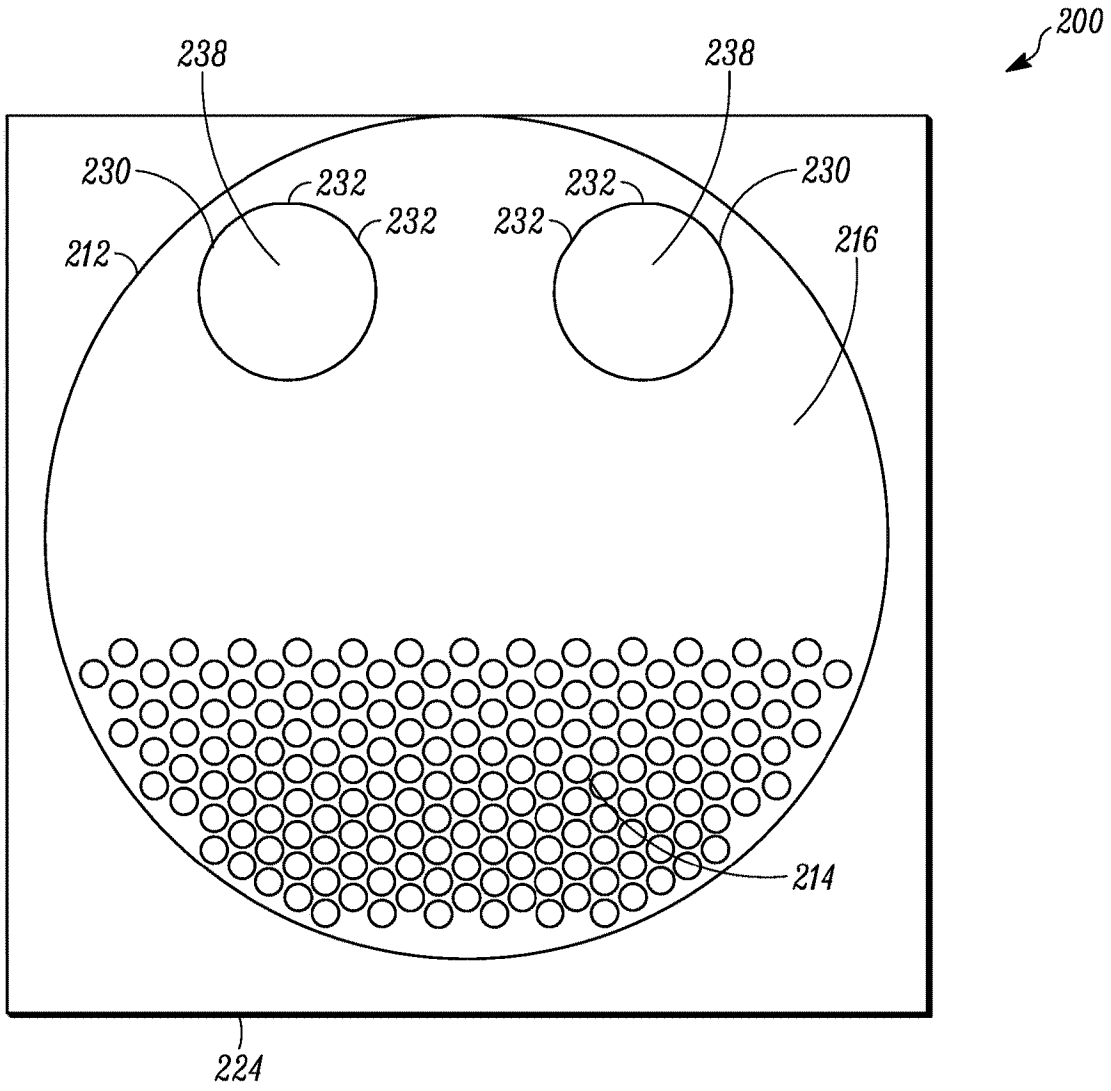
FIG. 10 is an end sectional view of an embodiment of a heat exchanger with an embodiment of multiple suction ducts.
Figure 11:
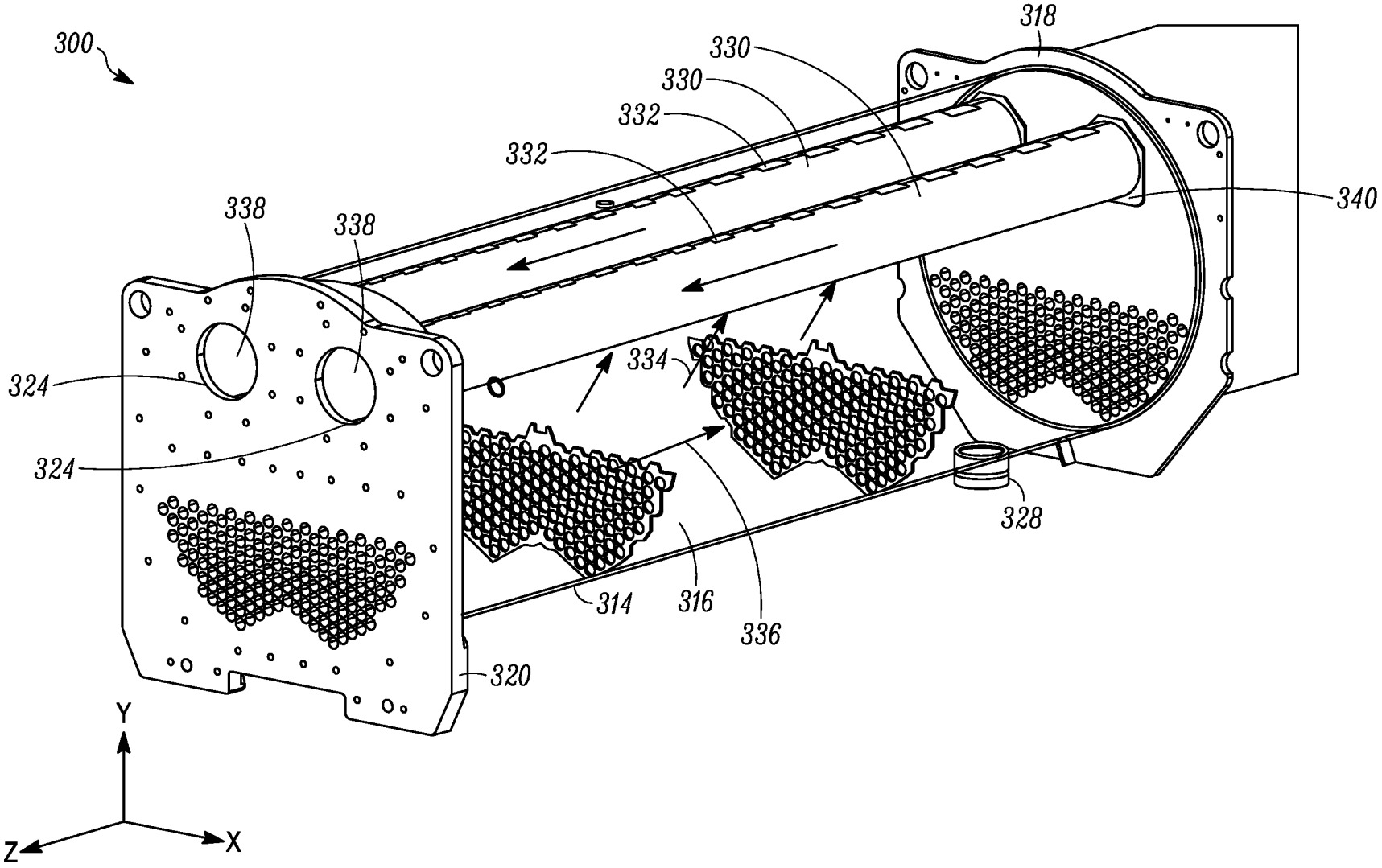
FIG. 11 is a perspective view of another embodiment of a heat exchanger showing another embodiment of multiple suction ducts within the heat exchanger.

FIGS. 10 and 11 show examples of this, where a shell 212, 312 of an evaporator 200, 300, such as for example a flooded-type evaporator includes two suction ducts 230, 330, respectively enclosed by the volume 216, 316, of the shell 212, 312. Each of the suction ducts 230, 330 shown in FIGS. 10 and 11 are similar in design as in FIGS. 1 to 9, but where there are two within the shell 212, 312. Similar approaches may be used with the area schedules 232, 332, of the suction ducts 230, 330 of FIGS. 10 and 11 as in FIGS. 1 to 9, and where like numbered elements are similar to those in FIGS. 1 to 9.

A shell and tube evaporator, such as for example a flooded evaporator may be used in a refrigeration system, such as for example a water chiller. The flooded evaporator in some instances for example is a flowing pool type flooded evaporator.

Multiple suction ducts may be employed within the shell of the evaporator to directly access the inside of the evaporator and from the side of the evaporator shell, such as by way of being supported by an end tube sheet of the evaporator shell. Such a configuration can be useful when employed for example in a refrigeration system with multiple compressors, e.g., two or more compressors, servicing the same cooling circuit. Using two or more, e.g., multiple separate connections to directly access the evaporator can be advantageous in some instances over a single duct or connection that would then need to split the flow upon leaving the shell of the evaporator.

In an embodiment, the suction duct(s) can generally have an annular shape, such as for example tubular, cylindrical, conical, and the like. The suction duct(s) have a flow path inside and within the perimeter wall shaping the duct(s). The suction duct(s) have an area schedule of openings to receive vapor refrigerant inside the duct(s) and be carried out of the shell through the flow path. The area schedule can have openings oriented toward the top of the duct(s) relative to the bottom of the shell. In an embodiment, the area schedule or openings face in a direction toward the top of the shell and a direction away from the bottom of the shell. In an embodiment the area schedule or openings face at an angle relative to vertical, and in some instances are angled away from sides of the shell and relatively in a direction toward the center and top of the shell. The openings can have an orientation, a geometry, scheduling, density, and/or metering, and the like to optimize the internal flow of the vapor within the shell of the evaporator and into the suction duct(s).

In an embodiment, the area schedule is located to face vertical. In an embodiment, the area schedule or openings relative to a top of the suction duct are in a location that is rotated or angled about the arcuate side of the suction duct. The openings face toward the side of the suction duct and are angled from vertical and also facing toward the center top of the shell, rather than located on the top facing vertical or located to face toward the sides of the heat exchanger shell. Orientation of the area schedule or openings can direct the flow to avoid dead spots, obtain uniform flow from the evaporation off the tube bundle.

The two or more compressor design in a single cooling circuit may be employed to obtain higher capacity rather than the use of one large compressor. Thus, depending on the number of compressors and the capacity provided by each of the compressors, the number of suction ducts and their configuration (e.g. size, orientation, as well as area schedule sizing, orientation, metering, etc.) may be appropriately determined.

In an embodiment, there is a one compressor for one suction duct ratio employed within a shared evaporator shell.

By using multiple suction ducts for multiple compressors, e.g., a suction duct for each compressor, there is no need to divide or balance flow outside of the shell with additional connections, joints, castings, hardware, e.g. tees, splitters, and the like, which can be expensive, complicated, and can impact operation and efficiency (e.g. added pressure drop, imbalanced flow, etc.). Use of the multiple suction ducts can provide multiple vapor flow streams with a direct line from inside the evaporator to the compressor.

In an embodiment, the compressors used can be of the same or different capacity (e.g. size), where each suction duct employed is also appropriately size with the respective compressor with which it may be paired.

In the example of employing a single duct for multiple compressors or one relatively larger compressor, a larger suction duct through the end tube sheet must be appropriately sized and used. By using multiple ducts of smaller size to service multiple compressors or large compressor, while accessing the evaporator shell through an end tube sheet, efficient use of the space inside the evaporator shell can be achieved. For example, the bottom of multiple ducts can be located relatively higher than using a single large duct, and multiple ducts can be spaced closer to the sides rather than a single duct located in the area toward the middle and top of the shell. Further, using multiple ducts can pull flow up through a center area of the shell and avoid dead spots in this area as well as dead spots toward the sides. Efficient use of the space can also be achieved by further clearance from the tube bundle, waterbox connection clearance, and avoiding liquid carryover.

During partial operation, e.g., part load where one or more of the compressors is not running or running at lower capacity, placement of the duct(s) toward the side can have little or no impact on efficiency, and in some instances can still address dead spots toward center and top area within the shell, as well as certain sides within the shell.

It will be appreciated that the suction duct configuration relative to the access into the evaporator shell is non-limiting. For example, either or both ends of the shell may be employed to access the inside of the evaporator shell, while being supported by an end tube sheet if available. For example, in the use of two compressors, the suction duct(s) may both access the same end or access different ends relative to the side of the evaporator shell. If more than two compressors are used, then the other end may be employed as needed. For example, in a three or four compressor scheme, two suction ducts could access the inside of the evaporator from one end, while the other one or two could access from the other end. It will be also be appreciated that when inside the shell, each suction duct employed may extend the same or different distances along the length of the shell, as appropriately designed for example to support the compressor with which a respective suction duct is paired. Thus, in a single cooling circuit using more than one compressor there are multiple configurations for the access into the side and end of the evaporator shell.

FIG. 10 is an end sectional view of an embodiment of a heat exchanger 200 with an embodiment of multiple suction ducts 230.

FIG. 10 shows an end schematic view of an embodiment of heat exchanger 200. The heat exchanger 200 in the embodiment shown is an evaporator, for example a flooded-type evaporator. The evaporator 200 has a shell 212 and tubes or tube bundle 214. Two suction ducts 230 are shown with a flow path 238. An area schedule or opening location 232 is provided that accesses the flow path 238. The area schedules or openings 232 are shown toward the top of the suction ducts 230 facing in a generally vertical direction. The area schedule 232 may be located at other parts of the suction duct, and relative to the shell 212. For example, the area schedule 232 can be located as angled from vertical, as also shown in FIG. 10 at the 232 on the side angling inward relative to the 232 on top. The suction ducts 230 can be supported by an end tube sheet 224 with openings through the tube sheet 224 that match the end profile of the suction ducts 230 as shown at 230, 232 in the Figure.

FIG. 11 is a perspective view of another embodiment of a heat exchanger 300 showing another embodiment of multiple suction ducts 330 within the heat exchanger 300.

The heat exchanger 300 in the embodiment shown is an evaporator, for example a flooded-type evaporator. The evaporator 300 has a shell 312 and tubes or tube bundle 314. Two suction ducts 330 are shown with a flow path 338. An area schedule or opening location 332 is provided that accesses the flow path 338. The area schedules or openings 332 are shown toward the top of the suction ducts 330 facing in a generally vertical direction. It will be appreciated that the area schedule 332 may be located at other parts of the suction duct, and relative to the shell 312, such as at angled orientations. For example, the area schedule 332 can be located as angled from vertical, angling inward relative to the 332 on top. The suction ducts 330 can be supported by one or more end tube sheets at the inlet side (water inlet side) 318 and outlet side (water outlet side) 320, and have a similar support 340 as in the suction duct 130 of FIGS. 3-5. The tube sheet, e.g. at the outlet side 320, has openings 324 therethrough on the side of the shell 312, which can match the end profile of the suction ducts 330, so that the suction ducts 330 may be inserted into the tube sheet. The evaporator 300 has a lubricant recovery port 328 for directing lubricant, e.g. oil that may pool in the shell 312. The lubricant recovery port 328 as shown is located or disposed proximate the inlet side 318.

Refrigerant vapor that is boiled off (see arrows and item 334) is drawn through a portion of the volume 316 of the shell 312, and toward the top of the shell 312 or to a relatively high position inside the shell 312.

In some embodiments, the area schedule 332 in the suction duct 330 can generally facilitate vapor flow that is upward and curved, for example toward a location of the shell with a relatively lower pressure, and then be taken into the flow path of the suction duct toward the outlet on the side of the shell. See e.g. vapor flow curved arrows at 334 within the volume 316 of the shell 312.

In some embodiments, this upward and to the side flow can have a relatively smooth curvature flow.

The design of the area schedule 332 can be achieved for example by looking at the flow of liquid, which is sometimes a mixture of lubricant (e.g. oil) and refrigerant (see e.g. arrow at 336), and the direction of the liquid flow where lubricant is increasing as refrigerant is boiled off or vaporized (see e.g. arrows at 334). In some cases, there can be areas within the shell 312 that may be susceptible to relatively higher occurrences of foaming, e.g. of lubricant, and where it may be desired to keep vapor currents relatively more benign. In some circumstances, it may be desired to have co-current flow of the flow of liquid (e.g. arrow at 336) and the flow of vapor (e.g. arrows at 334), so as not create occurrences of splash back or cause for example the vapor direction to fight back against direction of liquid flow. In some embodiments, the area schedule, e.g. 332, can be configured to direct the flow of vapor so that is relatively biased with the direction of the liquid flow. Axial distribution of the vapor within the shell 312 can be generated using heat transfer models and then controlling the area schedule 332, e.g. openings, to handle the vapor generation and achieve velocity vectors that may be desired. For example, heat transfer models, vapor generation models, and/or flash gas models (e.g. to account for vapor already generated by an expansion device when two-phase vapor and liquid flows into the shell from a distributor and to account for flows impacted by a distributor) can be used and/or computational fluid dynamics (CFD) testing can be performed, and the like.

Different Suction Outlets for Single and Multiple Suction Duct Configurations

In some embodiments, the outlet of the shell is not out of the side but rather out of the top of the shell. A flow path inside the suction duct is in fluid communication with the area schedule and the volume of the shell. The outlet of the shell is in fluid communication with the flow path of the suction duct.

In some embodiments, the area schedule in the suction duct can generally facilitate vapor flow that is uniform or has some uniformity in a direction going upward and curved into the suction duct, for example toward a location of the shell with a relatively lower pressure, and then be taken into the flow path of the suction duct toward the outlet of the shell. In some embodiments, this upward and curved flow can have a relatively smooth curvature flow.

Figure 12:
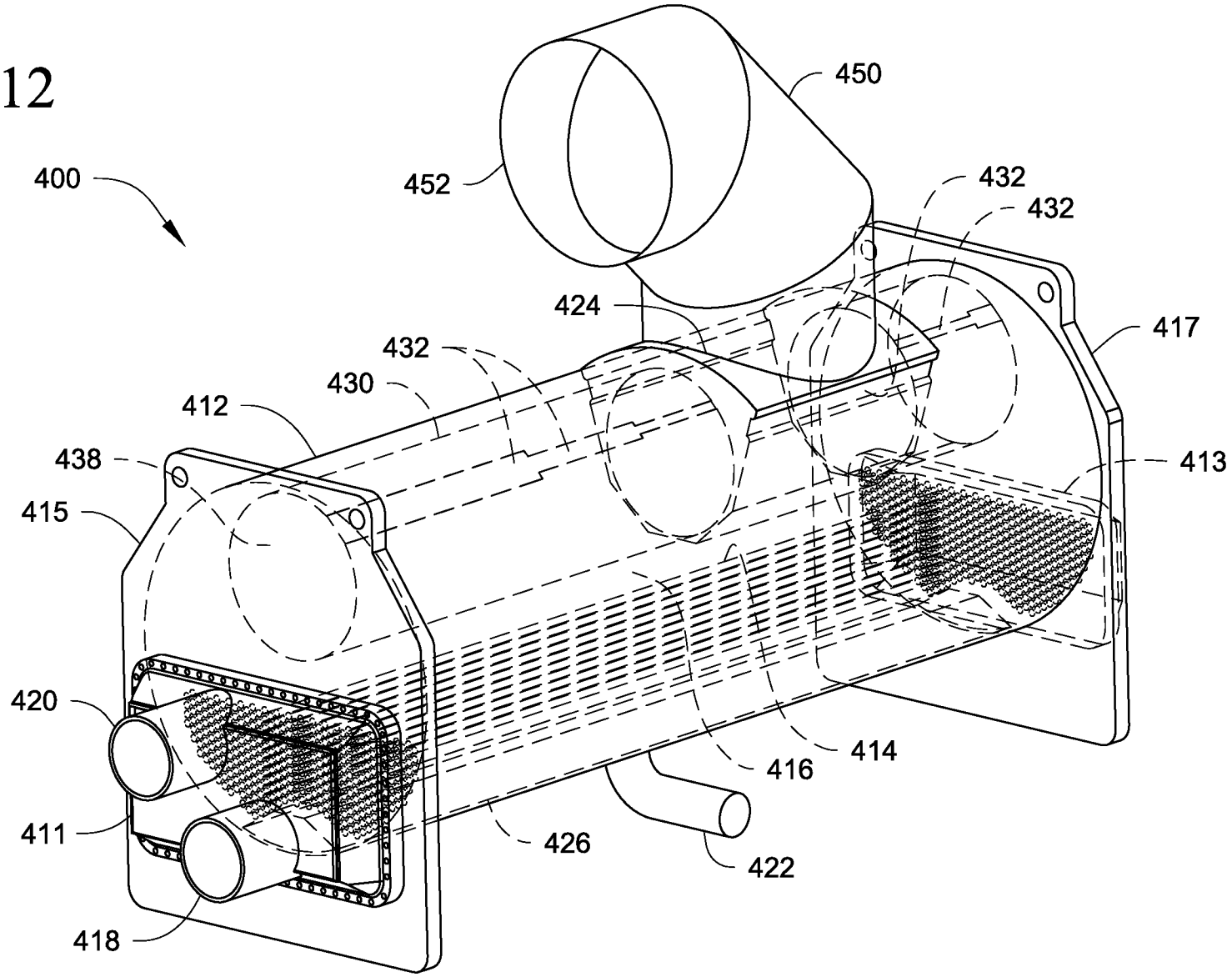
FIG. 12 is a perspective view of another embodiment of a heat exchanger showing another embodiment of a suction duct within the heat exchanger.
Figure 13:
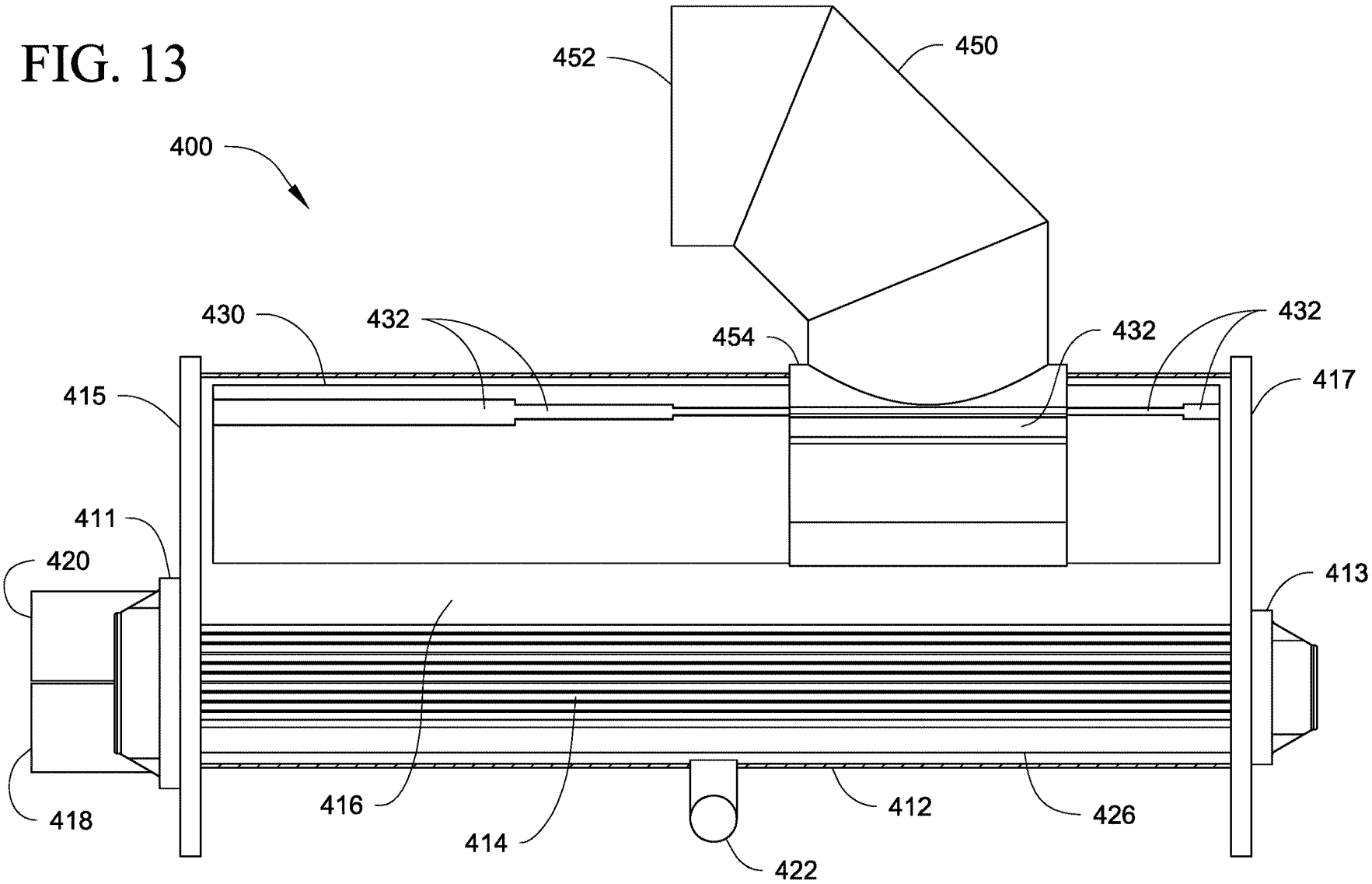
FIG. 13 is a side view of the heat exchanger and suction duct of FIG. 12, showing a side of the shell cutaway for viewing the inside.

FIGS. 12 and 13 show another embodiment of a heat exchanger 400 with a suction duct 430, where an outlet 452 is on the top of the shell 412. FIG. 12 is a perspective view the heat exchanger 400 and suction duct 430. FIG. 13 is a side view of the heat exchanger 400 and suction duct 430, showing a side of the shell 12 cutaway for viewing the inside components.

The heat exchanger 400 in the embodiment shown is an evaporator, for example a flooded-type evaporator. The heat exchanger (hereafter evaporator) 400 has a shell 412 and tubes or tube bundle 414. The suction duct 430 is shown with a flow path 438. An area schedule or opening location 432 is provided that accesses the flow path 438. The area schedules or openings 432 are shown toward the top of the suction duct 430 and angled from a vertical direction. It will be appreciated that the area schedule 432 may be located at other parts of the suction duct, and relative to the shell 412, such as at a vertical orientation. The suction ducts 430 can be supported by one or more end tube sheets 415, 417. In the embodiment shown, the evaporator is configured as a two pass evaporator where one of the tube sheets, e.g. 415, includes a water box 411 having both the inlet (water inlet) 418 and outlet (water outlet) 420 at one end. Return water box 413 is shown on the other tube sheet 417 at the other end. It will be appreciated that the evaporator 400 may also be constructed as a single pass similar to heat exchangers 10, 100, 200, and 300 above. Likewise it will be appreciated that heat exchangers 10, 100, 200, and 300 can be constructed as a multiple pass heat exchanger.

The heat exchanger 400 also includes a heat exchange fluid inlet 422, which can be in fluid communication with a distributor 426. In some examples, the heat exchange fluid is refrigerant, which may include a mixture of refrigerant (including vapor and liquid) and lubricant such as for example oil. As shown, the heat exchange fluid inlet 422 is located or disposed at about the middle of the shell 412. The evaporator 400 also has a lubricant recovery port for directing lubricant, e.g. oil that may pool in the shell 412.

Refrigerant vapor that is boiled off is drawn through a portion of the volume 416 of the shell 412, and toward the top of the shell 412 or to a relatively high position inside the shell 412.

In some embodiments, the area schedule 432 in the suction duct 430 can generally facilitate vapor flow that is upward and curved, for example toward a location of the shell with a relatively lower pressure, and then be taken into the flow path of the suction duct toward the outlet on the side of the shell. In some embodiments, this upward and curved flow can have a relatively smooth curvature flow.

The design of the area schedule 432 can be achieved for example by looking at the flow of liquid, which is sometimes a mixture of lubricant (e.g. oil) and refrigerant, and the direction of the liquid flow where lubricant is increasing as refrigerant is boiled off or vaporized. In some cases, there can be areas within the shell 412 that may be susceptible to relatively higher occurrences of foaming, e.g. of lubricant, that may have relatively higher pressure, and where it may be desired to keep vapor currents relatively more benign and/or to draw vapor toward relatively lower pressure areas of the shell 412. In some circumstances, it may be desired to have co-current flow of the flow of liquid and the flow of vapor, so as not create occurrences of splash back or cause for example the vapor direction to fight back against direction of liquid flow. In some embodiments, the area schedule, e.g. 432, can be configured to direct the flow of vapor so that is relatively biased with the direction of the liquid flow. Axial distribution of the vapor within the shell 412 can be generated using heat transfer models and then controlling the area schedule 432, e.g. openings, to handle the vapor generation and achieve velocity vectors that may be desired. For example, heat transfer models, vapor generation models, and/or flash gas models (e.g. to account for vapor already generated by an expansion device when two-phase vapor and liquid flows into the shell from a distributor and to account for flows impacted by a distributor) can be used and/or computational fluid dynamics (CFD) testing can be performed, and the like.

In an embodiment, the direction of fluid flow can help determine how to configure and/or optimize the area schedule 432 (as well as for 32, 132, 232, and 332). For example, the direction of the flow of liquid refrigerant through the shell, the direction of liquid flow through the distributor, e.g. 426, the placement, location, and/or size of the distributor, placement of the outlet (e.g. side(s) and/or top) relative to the suction duct may factor into determining the vapor flow generation within the shell. Once the vapor flow generation is determined, the area schedule can be constructed to control or modify the vapor flow to create smooth vapor flows.

In FIGS. 12 and 13, the outlet 452 is constructed as a top outlet from the shell 412. The volume 416 of the shell 412 is in fluid communication with the area schedule 432 of the suction duct 430, and the area schedule 432 is in fluid communication with the flow path 438. The flow path 438 is in fluid communication with the outlet 452.

As shown, the outlet 452 is constructed with line 450 that may be curved. In an embodiment, a collar 454 is connected with the line 450 and in some circumstances the collar 454 can help to support the suction duct 430. In the embodiment shown, the collar 454 has a portion within the shell 412 with a slot that is in fluid communication with the area schedule 432 of the suction duct 430.

As shown, the area schedule 432 can be constructed as an elongated slot of varying size along the suction duct 430. For example, the slot is wider toward the ends where the tube sheets 415, 417 are located, and then are thinner toward the line 450 and collar 454 of the outlet 452. This configuration can be designed for example due to one or more factors including for example the placement of the outlet, fluid flow through the shell 412 (e.g. refrigerant liquid flow and water pass flow), placement of the distributor, and the like.

It will be appreciated that heat exchangers, e.g. heat exchangers 10, 100, 200, 300, 400, can be implemented in a variety of compressor and fluid applications. The suction ducts herein can be implemented with a variety of heat exchange fluid types, including but not limited to: low pressure refrigerant applications, e.g. centrifugal chiller applications; high pressure refrigerant applications, e.g.

scroll compressor applications which may employ R410a; and medium pressure refrigerant applications, e.g. screw compressor applications which may employ R134a. The suction ducts herein may be particularly useful in applications employing relatively medium and high pressure refrigerants in a variety of compressor types.

In some embodiments, the heat exchangers herein, e.g. heat exchangers 10, 100, 200, 300, 400 can be implemented in a fluid chiller unit, such as may be included in an HVAC or refrigeration system.

In some embodiments, the heat exchangers herein, e.g. heat exchangers 10, 100, 200, 300, 400 can be used in a fluid chiller, such as for example a screw compressor fluid chiller, which may be employed for example in a HVAC and/or refrigeration unit and/or system.

In some embodiments, the heat exchangers herein, e.g. heat exchangers 10, 100, 200, 300, 400 may be used in relatively large centrifugal compressor fluid chillers.

Generally, in some embodiments, the heat exchangers herein, e.g. heat exchangers 10, 100, 200, 300, 400 can be used in fluid chillers that may have pressure drop issues. In some examples, such fluid chillers may employ a relatively higher pressure refrigerant, such as but not limited to for example R134A.

Generally, the suction ducts herein can be implemented in any suitable flooded evaporator, where there may be used relatively higher pressure refrigerants, and where there can be relatively more compromise on pressure drop.

Aspects

Aspect 1. A flooded type evaporator, comprising:

a shell including a volume therein, the shell extends in a longitudinal direction from a first end to a second end;

a tube bundle disposed within the shell;

a first tube sheet at the first end of the shell, and a second tube sheet at the second end of the shell; and a suction duct extending in the longitudinal direction, the suction duct includes a flow path therein and an area schedule in fluid communication with the volume of the shell, the area schedule has a configuration to direct flow toward relatively lower pressure areas of the shell.

Aspect 2. The flooded evaporator of aspect 1, wherein the flow path of the suction duct is in fluid communication with one of the first end and the second end of the shell, so as to provide a side outlet on the shell for the suction duct, and wherein one or both of the first tube sheet and the second tube sheet includes an opening to provide the side outlet in fluid communication with the suction duct.

Aspect 3. The flooded-type evaporator of Aspect 1 or 2, wherein the area schedule is disposed on a top of the suction duct.

Aspect 4. The flooded-type evaporator of any one of Aspects 1 to 3, wherein the area schedule is disposed at an angle on the suction duct.

Aspect 5. The flooded-type evaporator of any one of Aspects 1 to 4, wherein the configuration of the area schedule includes openings that are metered and/or have a density and/or have a geometry to optimize vapor flow inside the shell by obtaining uniform vapor flow from the evaporation off the tube bundle and avoid dead spots of flow in the shell.

Aspect 6. The flooded-type evaporator of any one of Aspects 1 to 5, wherein the suction duct is sized dependent upon a compressor with which the suction duct is paired.

Aspect 7. The flooded-type evaporator of any one of Aspects 1 to 6, wherein the suction duct extends a distance from the first end to the second end.

Aspect 8. The flooded-type evaporator of any one of Aspects 1 to 7, wherein the suction duct extends a distance less than from the first end to the second end.

Aspect 9. A refrigeration system comprising the flooded-type evaporator of any one or more of Aspects 1 to 8.

Aspect 10. A method of directing suction vapor from a flooded-type evaporator, comprising:

evaporating refrigerant within a volume of a shell by a heat exchange relationship of the refrigerant with a fluid passing through a tube bundle inside the shell;

directing the vaporized refrigerant to a portion of free area within the volume and above the tube bundle;

directing the vaporized refrigerant into a suction duct disposed above the portion of free area, the suction duct having an area schedule oriented to optimize vapor flow inside the shell by obtaining uniform vapor flow from the evaporation off the tube bundle and avoid dead spots of flow in the shell;

directing the vaporized refrigerant through a flow path of the suction duct; and directing the vaporized refrigerant out of the suction duct.

Aspect 11. The method of Aspect 10, wherein directing the vaporized refrigerant out of the suction duct includes directing the vaporized refrigerant through a side of the shell, where the side is at a longitudinal end of the shell.

Aspect 12. A flooded type evaporator, comprising:

a shell including a volume therein, the shell extends in a longitudinal direction from a first end to a second end;

a tube bundle disposed within the shell;

a first tube sheet at the first end of the shell, and a second tube sheet at the second end of the shell; and multiple suction ducts extending in the longitudinal direction, the multiple suction ducts each include a flow path therein and an area schedule in fluid communication with the volume of the shell, wherein the flow path of each suction duct is in fluid communication with one of the first end and the second end of the shell, so as to provide a side outlet on the shell for each suction duct, and wherein one or both of the first tube sheet and the second tube sheet includes at least one opening to provide the side outlets in fluid communication with each of the suction ducts.

Aspect 13. The flooded-type evaporator of Aspect 12, wherein each suction duct is configured to service one compressor of a refrigeration system, such that the flooded-type evaporator is a shared heat exchanger.

Aspect 14. The flooded-type evaporator of Aspect 12 or 13, wherein the area schedule is disposed on a top of one or more of the suction ducts.

Aspect 15. The flooded-type evaporator of any one of Aspects 12 to 14, wherein the area schedule is disposed at an angle on one or more of the suction ducts, and facing toward a top and center of the shell.

Aspect 16. The flooded-type evaporator of any one of Aspects 12 to 15, wherein the area schedule includes openings that are metered and/or have a density and/or have a geometry to optimize vapor flow inside the shell by obtaining uniform vapor flow from the evaporation off the tube bundle and avoid dead spots of flow in the shell.

Aspect 17. The flooded-type evaporator of any one of Aspects 12 to 16, wherein the suction ducts are sized dependent upon a compressor with which the respective suction duct is paired.

Aspect 18. The flooded-type evaporator of any one of Aspects 12 to 17, wherein one or more of the suction ducts extends a distance from the first end to the second end.

Aspect 19. The flooded-type evaporator of any one of Aspects 12 to 18, wherein one or more of the suction ducts extends a distance less than from the first end to the second end.

Aspect 20. A refrigeration system comprising the flooded-type evaporator of any one or more of Aspects 12 to 19.

Aspect 21. The refrigeration system of Aspect 20, wherein the compressors are part of a single cooling circuit.

Aspect 22. A method of directing suction vapor from a flooded-type evaporator, comprising:

evaporating refrigerant within a volume of a shell by a heat exchange relationship of the refrigerant with a fluid passing through a tube bundle inside the shell;

directing the vaporized refrigerant to a portion of free area within the volume and above the tube bundle;

directing the vaporized refrigerant into multiple suction ducts disposed above the portion of free area, the suction ducts having an area schedule oriented to optimize vapor flow inside the shell by obtaining uniform vapor flow from the evaporation off the tube bundle and avoid dead spots of flow in the shell;

directing the vaporized refrigerant through a flow path of the suction ducts; and directing the vaporized refrigerant out of the suction ducts through a side of the shell, where the side is at a longitudinal end of the shell.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the aspects or claims.

The invention claimed is:

1. A flooded-type evaporator, comprising:

a shell including a volume therein, the shell extends in a longitudinal direction from a first end to a second end;

a tube bundle disposed within the shell;

an inlet disposed at the bottom of the shell;

a first tube sheet at the first end of the shell, and a second tube sheet at the second end of the shell; and at least one suction duct extending in the longitudinal direction, the at least one suction duct includes a flow path therein and an area schedule in fluid communication with the volume of the shell, wherein the flow path of the at least one suction duct is in fluid communication with one of the first end and the second end of the shell, so as to provide a side outlet on the shell for the at least one suction duct, wherein the shell receives refrigerant from the inlet, evaporated refrigerant enters the at least one suction duct and exits the shell from the side outlet, wherein one or both of the first tube sheet and the second tube sheet includes at least one opening to provide the side outlet in fluid communication with the at least one suction duct, wherein the at least one suction duct includes a first suction duct and a second suction duct, and wherein the first suction duct is configured to service a first compressor, the second suction duct is configured to service a second compressor, and the flooded-type evaporator provides fluid to the first compressor and the second compressor.

* * * * *